US006189758B1

(12) United States Patent
Cherix

(10) Patent No.: US 6,189,758 B1
(45) Date of Patent: Feb. 20, 2001

(54) DRIVING DEVICE USING A FLEXIBLE ELEMENT TO ADJUST THE NIP GAP

(75) Inventor: Michel Cherix, Valais (CH)

(73) Assignee: Plumettaz SA, Bex (CH)

( * ) Notice: Under 35 U.S.C. 154(b), the term of this patent shall be extended for 0 days.

(21) Appl. No.: 09/266,721

(22) Filed: Mar. 12, 1999

(30) Foreign Application Priority Data

Mar. 18, 1998 (EP) ..... 98810227

(51) Int. Cl.[7] ..... B65H 5/02
(52) U.S. Cl. ..... 226/177; 226/172; 198/626.6
(58) Field of Search ..... 226/172, 177, 226/187, 176; 198/626.6, 626.4

(56) References Cited

U.S. PATENT DOCUMENTS

| | | | | |
|---|---|---|---|---|
| 1,481,886 | * | 1/1924 | Berg | 226/177 X |
| 2,679,924 | | 6/1954 | Powell . | |
| 2,759,728 | * | 8/1956 | Huck | 226/177 X |
| 2,796,781 | * | 6/1957 | Mills | 226/176 X |
| 2,821,253 | * | 1/1958 | Heffelfinger et al. | 226/187 X |
| 3,035,684 | * | 5/1962 | Conner | 198/626.6 |
| 3,052,393 | * | 9/1962 | McKenzie | 226/177 |
| 3,310,210 | | 3/1967 | Reib . | |
| 3,430,832 | * | 3/1969 | Meyer | 226/177 X |
| 3,620,432 | | 11/1971 | Emery . | |
| 3,792,948 | * | 2/1974 | Marinez . | |
| 4,173,278 | * | 11/1979 | Reitter | 198/626.6 X |
| 4,260,867 | * | 4/1981 | Coughlin et al. | 226/187 X |

FOREIGN PATENT DOCUMENTS

| | | | |
|---|---|---|---|
| 638936 | * | 3/1962 | (CA) . |
| 2725897 | * | 12/1977 | (DE) . |
| 0 185 788 | | 7/1986 | (EP) . |
| 1135086 | | 4/1957 | (FR) . |
| 2 719 794 | | 11/1995 | (FR) . |
| 908769 | | 10/1962 | (GB) . |
| 0223707 | * | 11/1985 | (JP) . |

* cited by examiner

*Primary Examiner*—Donald P. Walsh
*Assistant Examiner*—Collin A. Webb
(74) *Attorney, Agent, or Firm*—Oliff &Berridge, PLC

(57) ABSTRACT

A driving device for an elongated element such as a cable includes a device for simultaneously and symmetrically moving two driving track belts apart or closer together in relation to the elongated element. With this driving device, the two track belts can be brought against the elongated element while the elongated element's longitudinal axis remains constant. A single handle allows for simple adjustment of a gap between the two driving track belts and a spring device absorbs instantaneous variation of a transverse dimension of the elongated element.

19 Claims, 4 Drawing Sheets

DRIVING DEVICE USING A FLEXIBLE ELEMENT TO ADJUST THE NIP GAP

The content of Application No. 98810227.3, filed Mar. 18, 1998, in Europe is hereby incorporated by reference.

BACKGROUND OF THE INVENTION

1. Field of the Invention

The present invention relates to a driving device for advancing an elongated element, such as for instance a cable, a rope, a rod or any other elongated element, rigid or flexible, of any cross section profile.

2. Description of Related Art

It is known how to advance an elongated element in its axial direction by gripping it between two driving means, for example two wheels or two track belts. In the case where the elongated element is rigid, such as for instance a rod, the device can function by pushing or by pulling. In the case where the elongated element is flexible, such as for instance a rope, the device can function only by pulling.

The driving device must be capable of adapting to different elongated objects to transport, notably to the transverse dimension of the object, or to its diameter in the case of a cylindrical object, by adjusting the gap between the contact surfaces of the two driving means and two opposed surface portions of the object to transport.

In the known devices, the gap between the two driving means is adjusted by maintaining the position of one of the driving means and by transversely displacing the other driving means until the gap allows the object to travel between the two driving means. The disadvantage of such a device appears when one wishes for elongated elements of rather different diameters to travel. By keeping one driving device fixed, one has a transverse displacement of the elongated element's longitudinal axis for two elongated elements of different transverse dimensions. This can be a disadvantage in certain situations, notably in the case where the alignment of the axis of the elongated element to transport, relative to the devices which precede or follow the driving device, is important.

Another disadvantage of known devices is that it is generally difficult or sometimes impossible to adjust the set pressure of the two driving devices on the object while permitting the device to absorb an instantaneous variation of the object's transverse dimension, for example during the passage of a splice between two successive lengths of the object.

Yet another disadvantage of known devices is that the gap between the two driving means is adjusted by working successively on several distinct means, such as for instance on regulating screws, which is tedious and can entail a subsequent adjustment of the exact alignment of the driving device, especially in the case of two track belts.

On the other hand, in the case of tracked driving devices, it is sometimes necessary to replace one or the other of the driving track belts, either because of wear or to adapt them to the elongated element to transport. In the known devices, it is necessary to remove at least one of the tension rollers of each belt in order to loosen it so that it can be replaced.

SUMMARY OF THE INVENTION

A first purpose of the invention is to propose a driving device for advancing an elongated element fitted with means for adjusting the gap between two driving members that the position of the elongated element's axis is maintained irrespective of the transverse dimension of the elongated element.

A second purpose of the invention is to propose a driving device with members for adjusting the gap between the two driving means that is simple to operate and which allows for the adjustment value for the gap between the driving means to be easily obtained without it being necessary to subsequently adjust the alignment of the driving members.

Another purpose of the invention is to propose a tracked driving device for advancing an elongated element, fitted with means which allow for a quick replacement of one or both track belts.

The first aforementioned purpose is achieved by a driving device of the invention comprising the characteristics of the characterizing part of claim 1. Particular embodiments or variations are described in the dependent claims.

BRIEF DESCRIPTION OF THE DRAWINGS

The following description of a preferred embodiment of the driving device according to the invention is to be considered in relation to the attached drawing containing the figures, in which.

DETAILED DESCRIPTION OF PREFERRED EMBODIMENTS

Figure 1:
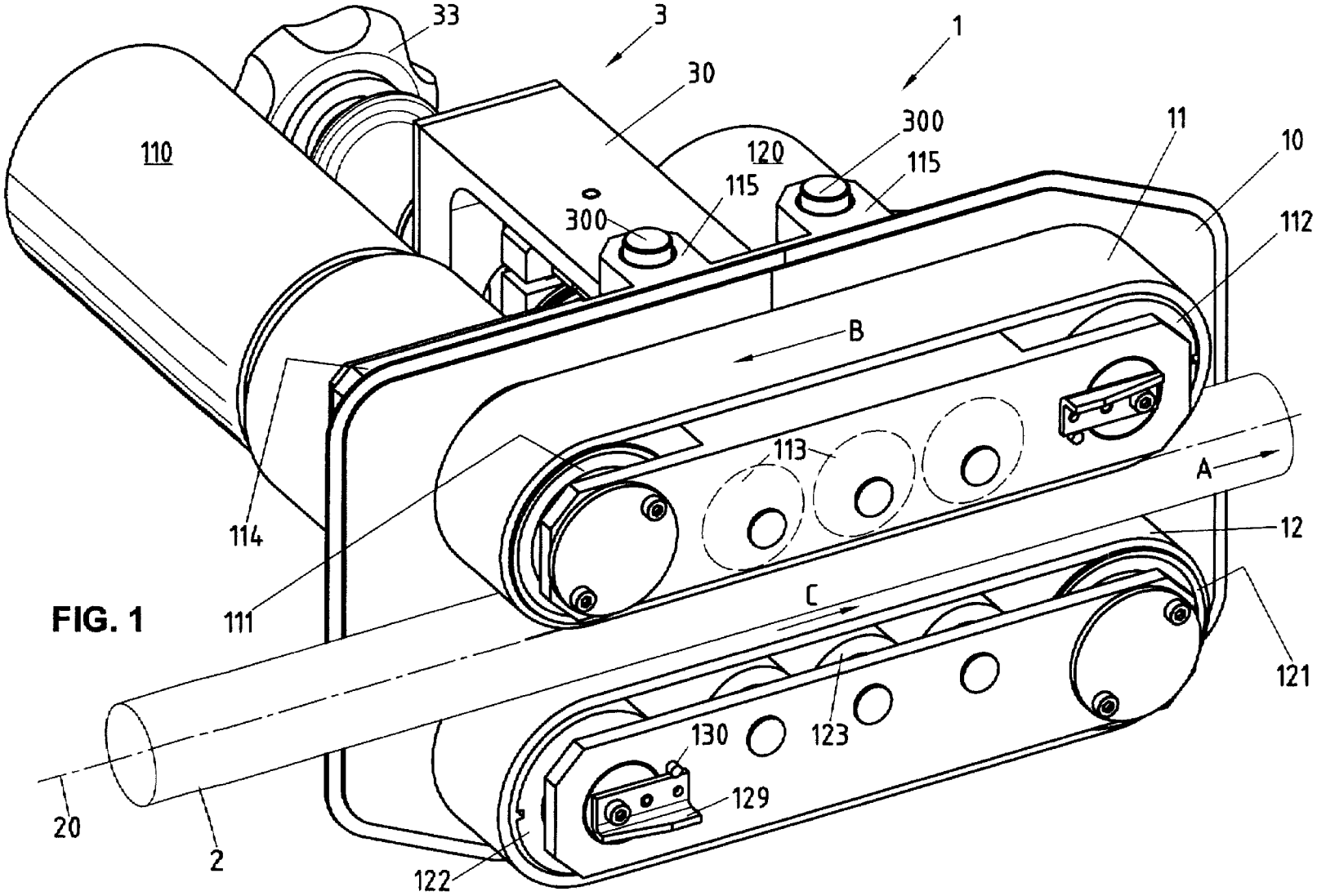
FIG. 1 is a front perspective view of a driving device according to the preferred embodiment of the invention.
Figure 2:
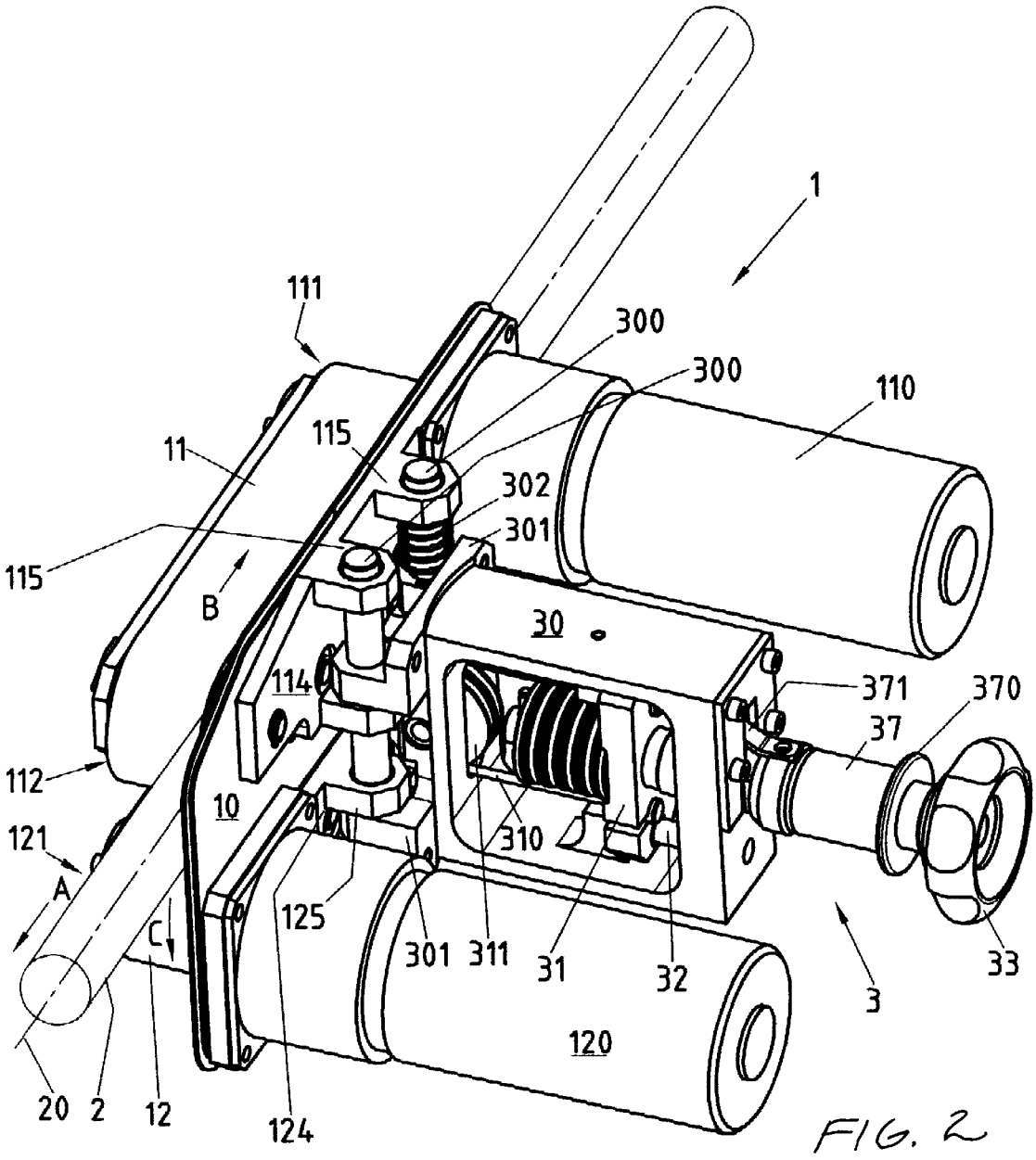
FIG. 2 is a rear perspective view of the same driving device.

The driving device 1 of FIGS. 1 and 2 is shown open, i.e., without its protective housing. The driving device 1 is intended to advance an elongated object 2, for example a cable, in its axial direction indicated by arrow A. The travelling object 2 has a longitudinal axis 20. The driving device 1 comprises a fixed supporting structure 10 on which are mounted, in a manner which is described further below, a first running carriage of a first track belt 11 and a second running carriage of a second track belt 12. The two track belts 11 and 12 are brought to bear collaterally on two opposed sides of the object 2 to transport. The two belts are themselves drawn along the direction indicated by arrows B and C by motorized means 110 and 120. The driving device 1 further comprises a means 3 for adjusting the gap between the two track belts 11 and 12, allowing for this gap to be adjusted to the transverse dimension of the object 2 to transport. This dimension can be the object's diameter.

In FIG. 1, one can see that each track belt 11 and 12 is an endless belt of which the material, surface properties and physical parameters such as hardness or superficial adherence can be adapted to the object 2 to transport. Each track belt 11 and 12 passes between a first drawing roller 111 or 121, each drawn by its motorized means 110 or 120, and a return idler 112 or 122 in free rotation. Between these two rollers 111 and 112, one has preferentially a number of carrying rollers 113, in free rotation, forming carrying. Likewise, carrying rollers 123 are provided between rollers 121 and 122. These carrying rollers prevent a deformation of the track belts 11 and 12 during their contact with the object 2 to transport. In the shown example, the drawing rollers 111 and 121 are placed at opposite extremities of the two track belts 11 and 12 only for reasons of space requirement of the motorized means 110 and 120. Any other disposition of the motorized means is also possible, and it is also possible to have only one motorized means 110 or 120 drawing one of the two track belts 11 or 12.

Figure 3:
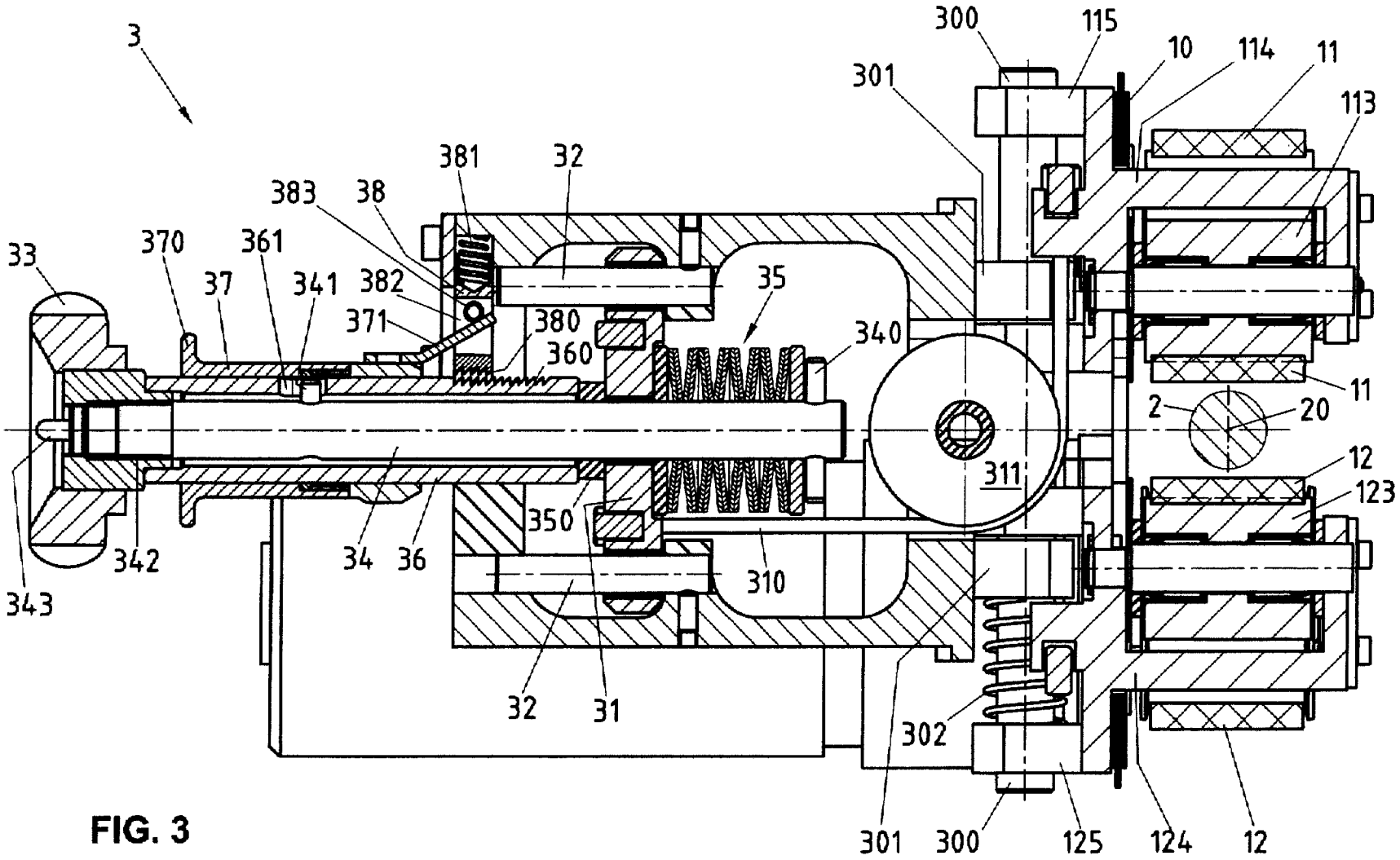
FIG. 3 is a cross section of the gap adjustment means for the device of the preceding figures.

When considering FIGS. 2 and 3, one sees that each running carriage of the track belts 11 and 12, the first running carriage constituted by rollers 111, 112 and 113, as well as the second running carriage constituted by rollers 121, 122 and 123, respectively is mounted on an independent platform 114, 124 respectively. The means 3 for adjusting the gap between the track belts 11 and 12, between the two platforms 114 and 124, comprises a support 30 fixed to the supporting structure 10. The support 30 comprises, on its extremity facing the track belts 11 and 12, first guides including two carriers 300 fixed by rectangular brackets 301 to the support 30. Each platform 114 and 124 comprises projections 115, 125, respectively fitted with a traversing hole engaged slidingly on one of the carriers 300. Thus, each of the platforms 114 and 124 can slide along the carriers 300 in order to move each of the track belts 11 and 12 closer to, or further away from, the object 2 to transport. At least one spring 302 is mounted on carrier 300 between a rectangular bracket 301 and projection 115 and 125 of each platform 114 and 124 so as to move apart the two platforms 114 and 124, and thus move the two track belts 11 and 12.

The moving together of the two platforms 114 and 124, and also the two track belts 11 and 12, is commanded by a stirrup 31, sliding preferably perpendicular to the direction of axis 20 of the object to transport and preferably perpendicular to the travelling direction of the platforms 114 and 124, on second guides 32 fixed to the support 30. Two small cables 310 (of which only one is visible in the figures) are tightened between stirrup 31 and each of the platforms 114 and 124, two return pulleys 311 returning each of the small cables issuing from stirrup 31 to one or the other platform 114 and 124. One thus, understands that when displacing stirrup 31 along the carriers 32, one exerts a traction pressure on the two small cables 310, which traction pressure is transmitted to the two platforms 114 and 124 causing them to move closer, respectively decreasing the gap between the two strands in relation to track belts 11 and 12.

Thus, the two platforms 114 and 124 carrying respectively the two track belts 11 and 12, that can slide along the guiding means 300, move naturally apart under the action of the springs 302 and can be moved closer together by acting on stirrup 31. By the simultaneous moving apart or moving closer of the two platforms 114 and 124 described previously, the two track belts 11 and 12 move apart or closer simultaneously and symmetrically in relation to the longitudinal axis 20 of the object to transport, the position of the longitudinal axis being thus maintained whatever the transverse dimension of the object 2, such as the diameter of cable 2.

The action of displacing stirrup 31 is commanded by a handle 33 acting on stirrup 31 by a shaft 34 passing through stirrup 31, by a spring device 35 and by an adjustable sleeve 36. A releasing sleeve 37, fitted with a seizing ring 370, is able to slide on the adjustable sleeve 36. The device further comprises a fastening means in a set position, including a piston 38 able to slide perpendicular to the axis of the adjustable sleeve 36 in a hollow of the support 30. The extremity of piston 38 near the adjustable sleeve 36 comprises a number of sprockets 380 able to engage in corresponding sprockets 360 arranged on a portion of the external surface of the adjustable sleeve 36 facing towards piston 38. A spring 381, placed on the extremity of piston 38 opposite to that fitted with the sprockets 380, pushes the piston 38 so that these sprockets 380 engage in the corresponding opposed sprockets 360 of the adjustable sleeve 36. The piston 38 can be acted in the opposite direction, i.e. to disengage the sprockets 380 from the sprockets 360, by means of an oblique lever 371 fixed by one of its extremities on the releasing sleeve 37, its other extremity being engaged in a hollow 382 of the piston 38 and resting on a bearing surface 383 of this hollow. The spring device 35 is placed on the portion of shaft 34 which is on the other side of stirrup 31 in relation to the handle 33. The spring device 35 in the represented embodiment includes a layering of spring lock washers, placed coaxially to shaft 34, and resting on one end on a face of stirrup 31 and on the other end on a stopping means 340, for instance a rod portion fixed transversely to the extremity of shaft 34. Between the other face of stirrup 31 and the extremity of adjustable sleeve 36, one has preferably a second spring device 350, of which the spring path and the spring constant are markedly inferior to those of the spring device 35 for a reason which shall be explained further below. The releasing sleeve 37 can only be displaced longitudinally, being prevented from swiveling around its axis notably by the engagement of oblique lever 371 into hollow 382. Similar means, not represented, also prevent the swiveling of the adjustable sleeve 36 around its axis, so that it can thus only be displaced longitudinally. The same applies to shaft 34 which is fitted with a wedge 341 mounted on a circumferential portion and transversely to the longitudinal axis of shaft 34. This wedge 341, engaged in a longitudinal slit 361 of the adjustable sleeve 36, restricts the possible movements of shaft 34 in relation to the adjustable sleeve 36, allowing only a longitudinal displacement of limited amplitude of shaft 34. Shaft 34 also comprises a threading 342 on its extremity engaged in handle 33.

The manner intended in this embodiment of the device for bringing the two track belts 11 and 12 to bear onto the object 2 to transport will now be described. FIG. 3 shows that the two track belts 11 and 12 are maximally spaced and that they should be brought to bear on the object 2 placed between them. For this, the operator grips the handle 33 in the palm of his hand and engages two fingers on the back side of the seizing ring 370 in order to draw this ring 370 towards the handle 33. In this way, the releasing sleeve 37 slides towards the handle 33 so that the oblique lever 371 lifts piston 38 in its hollow, which liberates the two serrated edges 360 and 380, as represented in the figure. In this position, the two track belts 11 and 12 are maintained apart by the springs 302 on the carriers 300, these springs having a spring constant markedly inferior to that of the spring lock washers 35 so that the relation between shaft 34 and stirrup 31 can be considered rigid. By pulling the handle 33 backwards, i.e. towards the left in FIG. 3, one thus draws by as much the stirrup 31 back towards the left, which, by means of the small cables 310, moves the two track belts 11 and 12 closer. As soon as these establish contact with object 2, a resistance to the traction is perceived on handle 33 and the operator can release the seizing ring 370, which engages the sprockets 380 on the opposite sprockets 360, fixing the stirrup 31 in a determined position of its displacement in which the two small cables 310 are tightened. As the serrated edges 380 and 360 have a certain pitch, defining stepped adjustment positions, a fine adjustment of stirrup 31 and consequently of track belts 11 and 12 can be obtained by slightly screwing the handle 33 which, by means of the threading 342 slightly displaces shaft 34, by compressing the second spring device 350 until the gap value wished between the two track belts 11 and 12 is achieved. By screwing the handle 33 further, it is possible to adjust the gripping force exerted by the two track belts 11 and 12 onto the object, this gripping force being then determined by the spring lock washers 35. A position marking device 343 is fixed onto the extremity of shaft 34 and protrudes through the middle of handle 33. By a visual or tactile check of the protrusion of the device out of the handle, it is possible to determined the value of the gripping force exerted onto object 2 by the track belts 11 and 12. Two reference marks (not shown) can furthermore be laid out one on the handle 33 and the other on the device 343 in order to allow for a fine adjustment of the gripping force by comparing the angular displacement between the two reference marks. The possible displacement of shaft 34 into adjusting sleeve 36, limited by the wedge 341 in slit 361, prevents the track belts 11 and 12 from bearing too strongly on object 2.

When operating the driving device for advancing the object 2, the situation might arise when the transverse dimension of object 2, notably its diameter, may vary suddenly, for instance during the passage of a splice between two successive lengths of the object. In that case, the device described is able to tolerate this variation in dimension, i.e. a sudden variation in the gap between the track belts 11 and 12, by means of the spring lock washers 35 which are able to absorb this divergence.

In order to move the track belts 11 and 12 apart again, it is sufficient to operate the seizing ring 370 to disengage the piston 38 and consequently the serrated edges 380 and 360, and then move the handle towards the right of the figure in order to liberate the tension exerted on the small cables 310. The two platforms 114 and 124 are then caused to move apart by the springs 302 as indicated previously.

In FIG. 3, one can observe that the serrated edges 360 and 380 are asymmetrical in order to improve the locking effect according to a known technique.

On can thus see that with a device such as that described, it is possible to adjust the gap between the two track belts 11 and 12 as well as the pressure applied by the track belts on the object to transport in a simple, quick and precise manner, with the use of only one hand. The adjustment device described here is particularly compact and is adapted for a driving device of small dimensions, such as for instance a device easily usable on a work site.

Other embodiments can be contemplated to ensure a link between the mobile stirrup 31 and the independent platforms 114 and 124; for instance, means comprising rods and cams could be considered also, it is not absolutely necessary that the direction of the stirrup's displacement be perpendicular to the direction of displacement of the platforms and/or to the axis to be maintained, in which case directional returning means should be provided. For more important devices, for instance a driving device installed permanently on a production machine in a plant, other means, manual or motorized, can be provided for displacing the stirrup 31 to a determined value.

The device has been described as being a driving device with track belts. However one could also have two driving wheels, each mounted on an independent platform as indicated and operating exactly as described for the tracked device.

The object to transport has been described as a cable of a certain diameter; in fact, the mentioned object could be an elongated element of any transverse dimension able to be advanced by a tracked or wheel driving device. Whatever the transverse dimension of the object to transport, the driving device allows for the object's axis to always remain in the same place.

Figure 4:
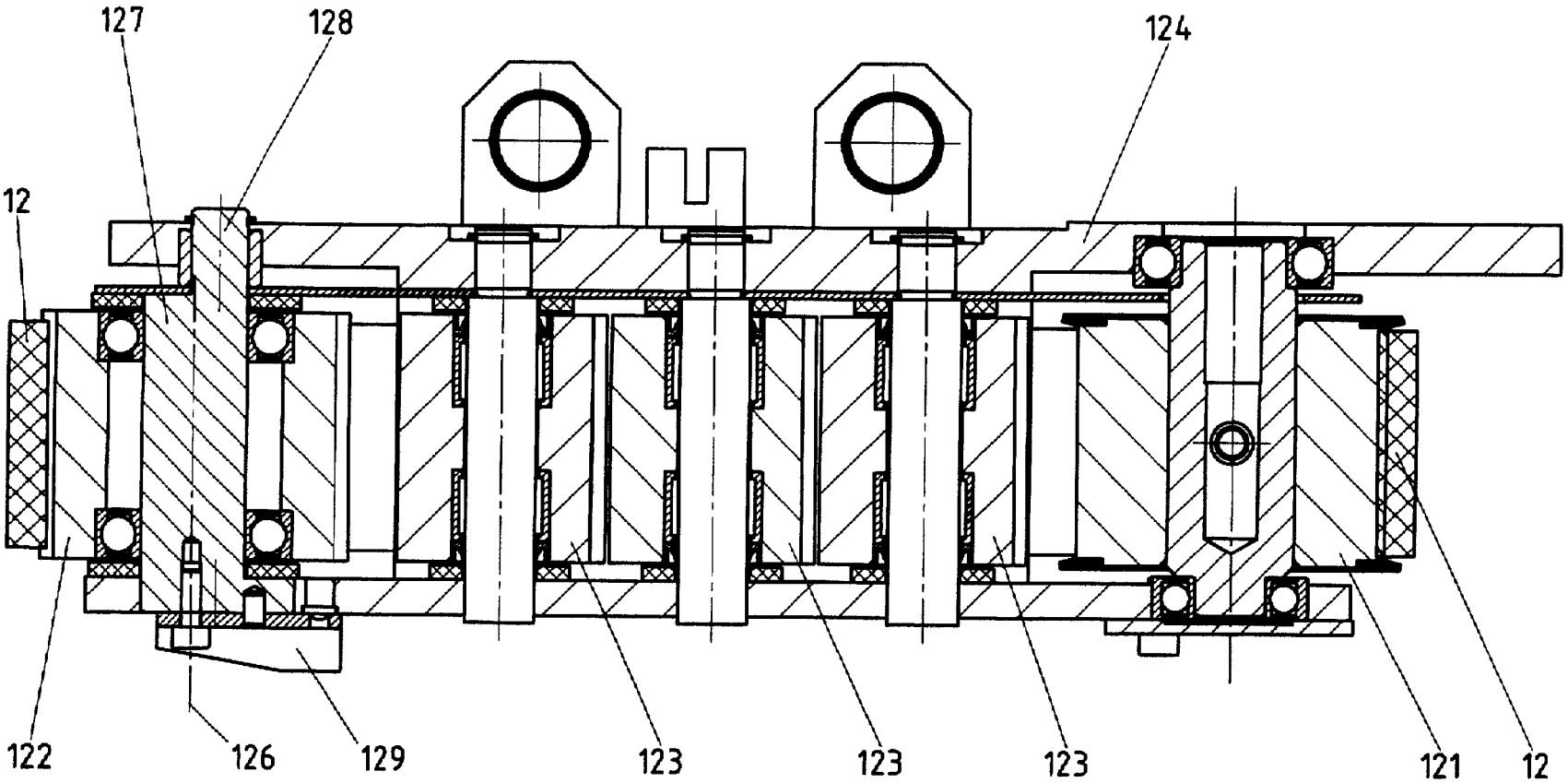
FIG. 4 is a cross section of a running carriage of a track belt.

FIG. 4 shows another improvement to the tracked driving device. As mentioned previously, it may become necessary to replace the track belt, because of wear or to adapt its mechanical parameters, for instance hardness, superficial adherence, surface properties, or width, to the elongated element to transport. FIG. 4 shows a cross section of the running carriage of the lower track belt of the preceding figures. One can observe notably platform 124, track belt 12, the drawing roller 121, the return idler 122 functioning as tension roller, as well as the intermediary rollers 123. When considering the tension roller 122, one can see that its rotational axis 126 is mounted on a shaft 127 carrying a shaft portion 128 set eccentrically in relation to the rotational axis 126. The eccentric shaft portion 128 is engaged pivotally in a hollow of platform 124. A lever 129 is fixed at the extremity of shaft 127 so that shaft 127 can be swung over its shaft portion 128, which loosens track belt 12, allowing it to be removed in order to be replaced. On can see in FIG. 1 a stop 130 which allows the lever 129 to be maintained in a position corresponding to the tensioned position of track belt 12. The running carriage of the higher track belt is fitted with the same device.

Such a device allowing for a quick replacement of a track belt without it being necessary to perform a tedious disassembly of a part of the machine and can be installed on any tracked driving device, notably a tracked driving device fitted with means for adjusting the gap of the two track belts as previously described.

What is claimed is:

1. A driving device for advancing an elongated element, comprising:

a supporting structure;

two driving members, each brought to bear symmetrically on at least one opposed surface portion of the element, each said driving member being mounted on an independent platform slidable along guides attached to said supporting structure; and means for adjusting a gap between said two driving members, said means adjusting simultaneously and symmetrically a position of each of said driving members relative to a longitudinal axis of the elongated element by sliding of each said platform on said guides, wherein the gap is maintained open by a first resilient element and adjustment of the gap closer together is performed by sliding of a mobile stirrup, said mobile stirrup being slidingly mounted on a support attached to said supporting structure and attached to each said platform.

2. The driving device according to claim 1, wherein each platform is connected to said mobile stirrup by a flexible element of a constant length passing through at least one return pulley.

3. The driving device according to claim 2, wherein the flexible element for each platform includes a cable element of determinate length, one extremity of said cable element being connected to said mobile stirrup and another extremity being connected to one of said platforms.

4. The driving device according to claim 1, wherein the mobile stirrup is displaced by a driving shaft, one extremity of said driving shaft being connected to said mobile stirrup and another extremity of said driving shaft having a handle.

5. The driving device according to claim 4, wherein the connection between said driving shaft and said mobile stirrup is through a second resilient element.

6. A driving device according to claim 5, wherein said mobile stirrup is mounted slidingly on said driving shaft and said second resilient element includes a compression spring attached at one end to said driving shaft and at another end rests against a first face of said mobile stirrup.

7. A driving device according to claim 6, wherein an adjustment position of said mobile stirrup is achieved by fastening means on said driving shaft according to a determined longitudinal position of said driving shaft in relation to said support of said supporting structure.

8. A driving device according to claim 7, wherein said fastening means includes an adjustable sleeve sliding on a portion of said driving shaft near said handle, an extremity of said adjustable sleeve resting against a face of said mobile stirrup opposite said first face, a portion of an external surface of said adjustable sleeve including first sprockets engageable with corresponding second sprockets on a mobile piston located within a hollow of said support, said mobile piston controlling locking of said first and second sprockets.

9. The driving device according to claim 8, wherein the extremity of said adjustable sleeve near said mobile stirrup rests against the mobile stirrup by force from a third resilient element, a spring constant and spring path of said third resilient element being lesser than a spring constant and spring path of said second resilient element, the other extremity of said adjusting sleeve resting against said handle.

10. A driving device according to claim 8, further comprising a releasing sleeve slidingly mounted on said adjusting sleeve, said releasing sleeve including a seizing ring on an extremity near said handle and means for disengaging said first and second sprockets.

11. The driving device according to claim 10, wherein said releasing sleeve, said adjustable sleeve and said driving shaft further include means for preventing swiveling about their respective longitudinal axes.

12. The driving device according to claim 11, wherein said handle is attached to the another end of said driving shaft by a threading, screwing of said handle in a direction allowing fine adjustment of the position of said mobile stirrup.

13. The driving device according to claim 12, wherein the screwing of said handle allows adjustment of a gripping force of said driving members on the elongated element.

14. The driving device according to claim 13, wherein the handle end of said driving shaft includes a protruding position marking device, said protruding position marking device relative to said handle defining a set value of the gripping force of said driving members.

15. The device according to claim 1, wherein said two driving members each include at least one driving wheel rotationally drawn by a motor.

16. The device according to claim 1, wherein at least one of said two driving members includes a track belt placed on a running carriage having a roller rotationally drawn by a motor.

17. The device according to claim 16, wherein said running carriage comprises a roller mounted about a first rotational axis on a shaft fitted with an eccentric bearing parallel to the first rotational axis, a lever connected to said shaft being pivotal to drive said shaft pivotally around said eccentric bearing to loosen said track belt.

18. A method of driving an elongated element utilizing the driving device of claim 1, wherein the driving device is a mobile driving device, comprising the steps of:

providing the mobile driving device at a working site;

introducing the elongated element into the mobile driving device; and adjusting the gap between said two driving members so as to allow the elongated element to be driven by the mobile driving device.

19. A method of driving an elongated element utilizing the driving device of claim 1, wherein the driving device is a fixed driving device, comprising the steps of:

providing the fixed driving device as part of a production line;

introducing the elongated element into the fixed driving device; and adjusting the gap between said two driving members so as to allow the elongated element to be driven by the fixed driving device.

* * * * *